US006153311A

United States Patent [19]

Springer et al.

[11] Patent Number: 6,153,311

[45] Date of Patent: Nov. 28, 2000

[54] SOFT SCULPTED ARTICLE AND METHOD OF MAKING SAME

[75] Inventors: Bradley W. Springer, Lee's Summit, Mo.; Ruth M. Donikowski, Lenexa; Anne L. Thurlow, Leawood, both of Kans.

[73] Assignee: Hallmark Cards Incorporated, Kansas City, Mo.

[21] Appl. No.: 09/265,712

[22] Filed: Mar. 9, 1999

[51] Int. Cl.[7] ..... A47G 35/00

[52] U.S. Cl. ..... 428/542.2; 428/15; 428/68; 428/71; 428/542.6; 446/268; 446/369; 446/372; 446/389; 446/392; 446/395

[58] Field of Search ..... 428/542.2, 15, 428/542.6, 34.1, 34.2, 68, 71, 304.4, 308.4; 446/372, 392, 395, 385, 389, 369, 268, 328

[56] References Cited

U.S. PATENT DOCUMENTS 3,574,968 2/1992 Schlau ..... 46/22

5,084,930 2/1992 Danova ..... 5/502

*Primary Examiner*—Deborah Jones

*Assistant Examiner*—Abraham Bahta

*Attorney, Agent, or Firm*—Pillsbury Madison & Sutro, LLP

[57] ABSTRACT

A soft sculpted article includes a first substantially flat surface and a soft sculpted face affixed to the first substantially flat surface. The face includes at least a muzzle portion extending outwardly of the first substantially flat surface.

23 Claims, 3 Drawing Sheets

SOFT SCULPTED ARTICLE AND METHOD OF MAKING SAME

FIELD OF THE INVENTION

The present invention relates generally to the field of surface ornamentation, and more particularly to a useful or decorative article having at least one flat surface with a plush, three-dimensional, soft sculpted feature protruding from the flat surface.

DESCRIPTION OF THE PRIOR ART

There is a tremendous demand for articles with decorative surface ornamentation. People enjoy having useful articles that are pleasing in appearance. Accordingly, manufacturers are continually striving to create new and different ornamental features and aesthetic designs for useful articles.

A familiar example of a useful article with a decorative appearance is a book. Book publishers have long attempted to make book covers aesthetically pleasing with various bindings and surface ornamentations. Recently, there has been produced a book cover that includes a plush fabric covering. The plush fabric covering may include a flat representation of a character's face. The character's face may be produced by embroidery or by cut-outs. The plush fabric cover with flat facial feature concept has been applied to other useful articles, such as pencil cups, and the like.

It is an object of the present invention to provide an improved surface ornamentation for useful articles.

SUMMARY OF THE INVENTION

The present invention provides a soft sculpted article and a method of making same. The article includes a first substantially flat surface and a soft sculpted face affixed to the first substantially flat surface. The face includes at least a muzzle portion extending outwardly of the first substantially flat surface.

The soft sculpted face includes a substantially flat substrate affixed to the first substantially flat surface, a padding form positioned on the substrate, and a fabric covering the padding form and at least a portion of the substrate. The fabric is affixed to the substrate around the padding form, and the padding form is preferably affixed to the substrate.

The padding form is sculpted to define the muzzle portion. The fabric is affixed to at least a portion of said padding form, preferably by sewing or embroidery thread. The thread forms a facial feature, such as a nose or mouth on the muzzle portion. Attachments, such as buttons, are affixed to the fabric to define eyes. Preferably, attachments of fabric or the like are affixed to the fabric to define ears extending outwardly of the first substantially flat surface. A decorative article, such as bow, may be affixed to the fabric.

The soft sculpted article of the present invention may include a second substantially flat surface and a fabric covering at least a portion of the second substantially flat surface. The fabric covering the second substantially flat surface may including a tail extending outwardly of the second substantially flat surface.

The substantially flat surfaces are structural elements of useful articles. The substantially flat surfaces may be substantially rigid, such as book covers, box panels, and backs of mirrors, picture frames, and the like. Additionally, the substantially flat surfaces may be flexible, such as greeting card or gift bag panels.

DESCRIPTION OF THE PREFERRED EMBODIMENT

Figure 1:
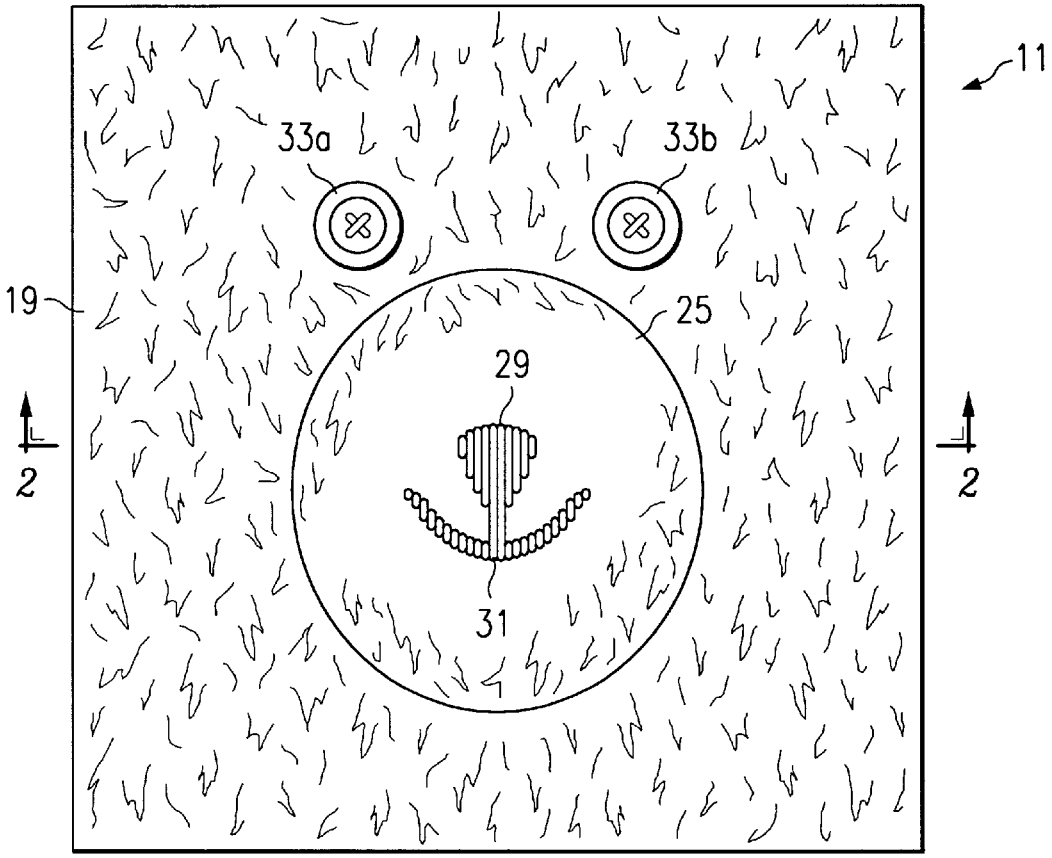
FIG. 1 is a front view of a soft sculpted face according to the present invention.
Figure 2:
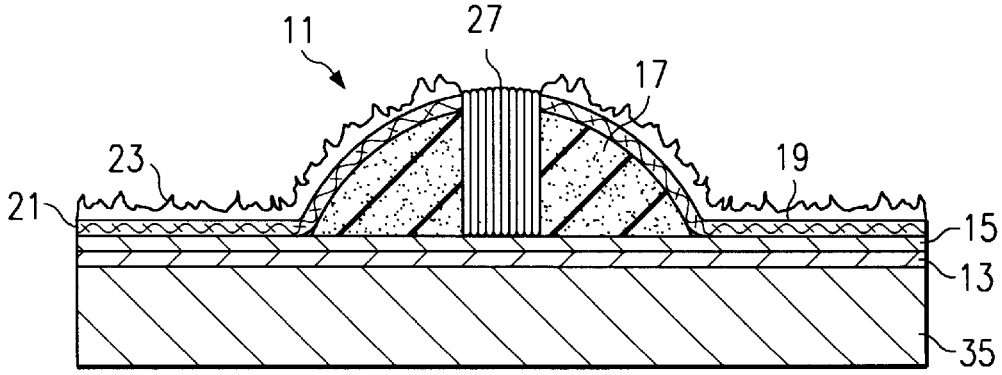
FIG. 2 is a sectional view taken along line 2—2 of FIG. 1.

Referring now to the drawings, and first to FIGS. 1 and 2, a soft sculptured face according to the present invention is designated generally by the numeral 11. Face 11 is formed on a flat substrate 13. In the preferred embodiment, substrate 13 is formed of heavy paper, such as craft paper, or light cardboard.

Substrate 13 is coated with a layer of adhesive 15. In the drawings, various features are not necessarily to scale and adhesive layer 15 is a thin layer of adhesive, such as contact, cement, or the like. A padding form 17 is positioned on substrate 13 and adhered thereto by adhesive layer 15. Padding form 17 is preferably made of a plastic foam, such as polyurethane foam, and is sculpted to define a facial feature.

In the embodiment of FIGS. 1 and 2, the facial feature is an animal's muzzle; however, as will be seen with respect to alternative embodiments, padding form 17 may be sculpted to define other or additional features of a character's face. Moreover, the face may be that of a human or a cartoon character. In any event, padding form 17 extends outwardly from substrate 13 to provide a three-dimensional feature.

Substrate 13 and padding form 17 are covered with a layer of plush fabric 19. Plush fabric 19 is of the type well known in the art and it includes a fabric backing 21 that carries a pile or nap 23. Plush fabric 19 simulates the fur of an animal. Plush fabric 19 is adhered to substrate 13 around padding form 17 by adhesive 15. Plush fabric 19 conforms to padding form 17 to define a muzzle 25 of an animal's face.

Plush fabric 19 is preferably affixed to padding form 17 prior to adhering padding form 17 and plush fabric 19 to substrate 13. In the preferred embodiment, plush fabric 19 is affixed to padding form 17 by means of sewing or embroidery thread 27. As shown in FIG. 1, embroidery thread 27 forms the appearance of an animal's nose 29 and mouth 31 on muzzle 25. Also as shown in FIG. 1, face 11 includes a pair of buttons 33 that are sewn to plush fabric 19 to create the appearance of eyes. Alternatively, eyes may be formed by embroidery. Preferably, buttons 33 are sewn to plush fabric 19 prior to the affixation of plush fabric 19 to substrate 13. As will be shown with respect to alternative embodiments, additional facial features, such as ears, may be affixed to plush fabric 19. Additional features, such as bows and the like, may also be affixed to plush fabric 19. In a further alternative embodiment, a tail or the like may be formed on a flat substrate in a manner as described with respect to the face.

According to the present invention, and shown in FIG. 11, Face 11 is affixed by adhesive or the like to a flat surface 35. Flat surface 35 may be a substantially rigid panel of wood, heavy cardboard, plastic, or the like, and be part of an article such as a book cover, a panel forming a box, or the like.

Alternatively, flat surface 35 may be a flexible panel of paper light cardboard, and be part of an article such as a greeting card or gift bag panel. Preferably, Face 11 is affixed to the flat surface 35 by adhering substrate 13 to surface 35.

Figure 3A:
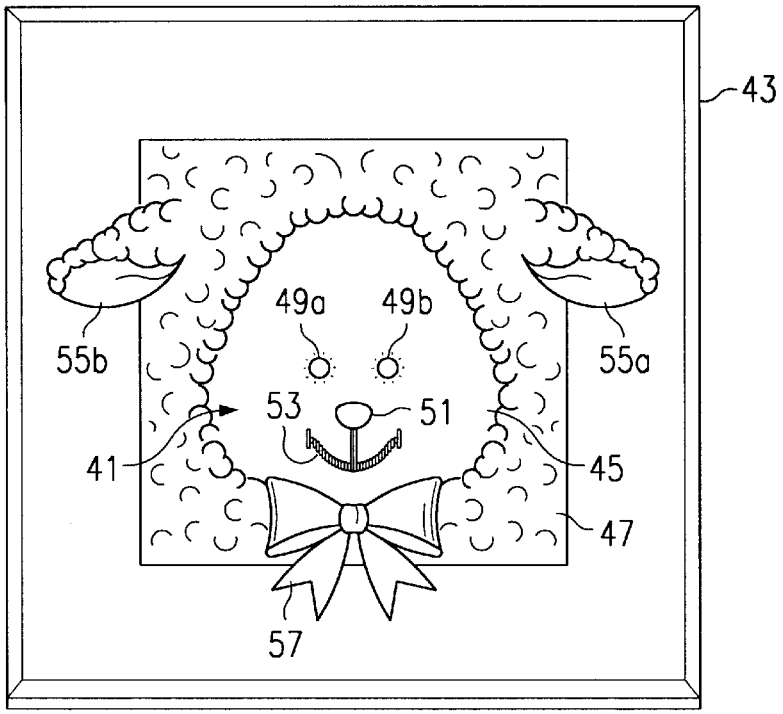
FIG. 3A is a front view of a framed article according to the present invention.
Figure 3B:
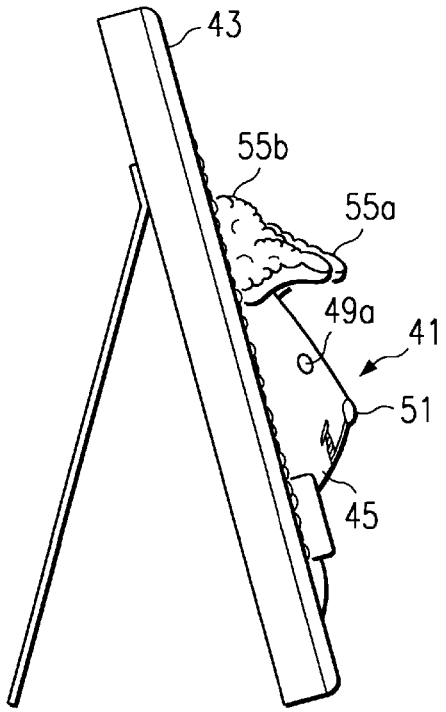
FIG. 3B is a side view of the article of FIG. 3A.

Referring now to FIG. 3A, there is shown an embodiment of the present invention incorporated into a picture frame. In the embodiment of FIGS. 3A and 3B, the present invention provides a decorative article, itself, rather than ornamentation to a useful article. In the embodiment of FIGS. 3A and 3B, a lamb's face 41 made according to the present invention is mounted in a frame 43. Lamb's face 41 includes an outwardly protruding muzzle portion 45 and a flat portion 47. Muzzle portion 45 is formed from a relatively smooth plush material and it has formed thereon a pair of eyes 49, a nose 51, and a mouth 53. Flat portion 47 is formed from a high pile plush material giving flat portion 47 a wooly appearance. A pair of fabric ears 55 made of plush material are affixed to flat portion 47 and extend outwardly. Additionally, a bow 57 is affixed to flat portion 47.

Figure 4A:
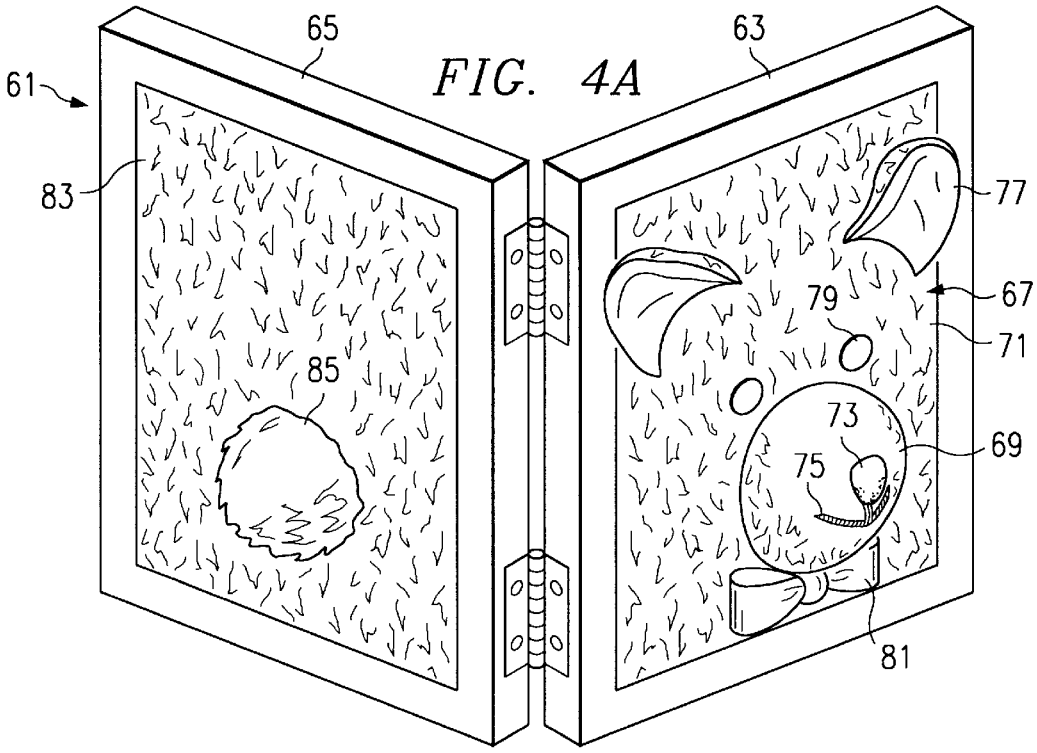
FIG. 4A is a front perspective view of hinged picture frame according to the present invention.
Figure 4B:
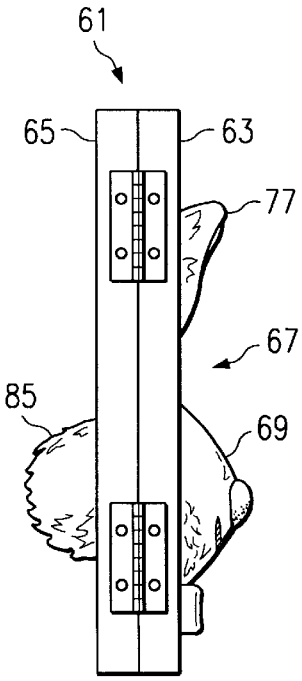
FIG. 4B is a side perspective view of the hinged picture frame of FIG. 4A.

Referring now to FIGS. 4A and 4B, there is shown an alternative embodiment of the present invention that is incorporated into a hinged picture frame 61. Frame 61 includes a first panel 63 and a second panel 65 that are hinged together. Panels 63 and 65 are movable between an open position shown in FIG. 4A, and a closed position shown in FIG. 4B. First panel 63 has affixed thereto the face 67 of a bear. Face 67 includes an outwardly protruding muzzle portion 69 and a flat portion 71. Muzzle portion 69 is made of a relatively smooth plush material and it includes a nose 73, and a mouth 75. Flat portion 71 is made of a relatively high pile plush material to simulate the fur of a bear. Fabric ears 77 are affixed to flat portion 71 and extend outwardly therefrom. In addition to ears 71, eyes 79, and a bow 81 are affixed to flat portion 71.

Second panel 65 has affixed thereto a layer of plush material 83. Plush material 83 is of the same type as flat portion 71 to present the appearance of bear fur. Flat portion 71 includes a tail 85. In the embodiment shown in FIGS. 4A and 4B, tail 85 is formed by a padding form disposed between plush material 83 and second panel 65, in the manner described with respect to FIGS. 1 and 2. Alternatively, a tail may be separately fabricated in the manner of ears 77 and sewn on to plush material 83.

Figure 5:
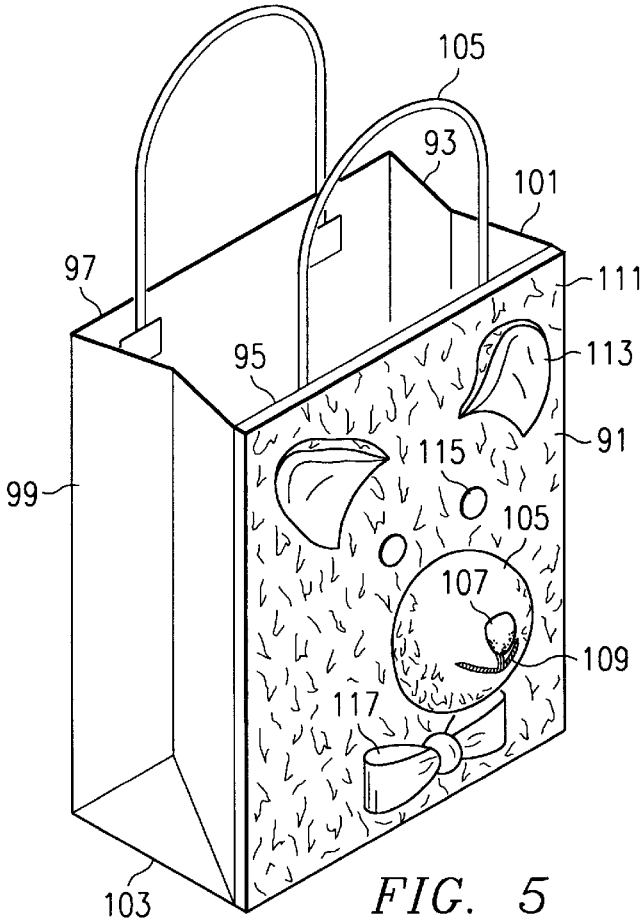
FIG. 5 is a perspective view of a gift bag according to the present invention.

Referring now to FIG. 5, there is shown yet a further embodiment of the present invention in which a face 91 is affixed to a panel of a gift bag 93. Gift bag 93 is of conventional construction and it includes a front panel 95, a back panel 97, side panels 99 and 101, and a bottom panel 103. In the manner well known to those skilled in the art, handles 105 are provided. Face 91 is made as described with respect to FIGS. 1 and 2. Face 91 includes an outwardly projecting muzzle portion 105 that has formed thereon a nose 107 and a mouth 109. Face 91 also includes a flat portion 111 that has affixed thereto ears 113, eyes 115, and a bow 117.

From the foregoing, it may be seen that the present invention provides an article with improved surface ornamentation. The present invention has been illustrated and described with respect to presently preferred embodiments. Those skilled in the art will recognize alternative arrangements and designs, given the benefit of this disclosure.

What is claimed is:

1. A soft sculpted article, which comprises:

a first substantial flat surface; and, a soft sculpted face including a substantially flat substrate affixed to said first substantially flat surface, a padding form affixed to said substrate and a fabric covering said padding form and at least a portion of said substrate, said fabric being affixed to said substrate around said padding form to define a muzzle portion extending outwardly of said first substantially flat surface.

2. The soft sculpted article as claimed in claim 1, wherein said fabric comprises a plush material.

3. The soft sculpted article as claimed in claim 1, wherein said padding form is sculpted to define said muzzle portion.

4. The soft sculpted article as claimed in claim 1, wherein said fabric is affixed to at least a portion of said padding form.

5. The soft sculpted article as claimed in claim 4, wherein said fabric is affixed to said at least a portion of said padding form by thread.

6. The soft sculpted article as claimed in claim 5, wherein said thread forms a facial feature on said muzzle portion.

7. The soft sculpted article as claimed in claim 6, wherein said facial feature includes a mouth.

8. The soft sculpted article as claimed in claim 6, wherein said facial feature includes a nose.

9. The soft sculpted article as claimed in claim 1, wherein said padding form is affixed to said substrate by adhesive.

10. The soft sculpted article as claimed in claim 1, wherein said fabric is affixed to said substrate by adhesive.

11. The soft sculpted article as claimed in claim 1, including attachments affixed to said fabric to define eyes.

12. The soft sculpted article as claimed in claim 11, wherein said attachments include buttons.

13. The soft sculpted article as claimed in claim 12, wherein said buttons are affixed to said fabric by sewing.

14. The soft sculpted article as claimed in claim 1, including attachments affixed to said fabric to define ears extending outwardly of said first substantially flat surface.

15. The soft sculpted article as claimed in claim 1, including a decorative attachment affixed to said fabric.

16. The soft sculpted article as claimed in claim 15, wherein said decorative attachment includes a bow.

17. A soft sculpted article, which comprises:

a first substantially flat surface;

a soft sculpted face affixed to said first substantially flat surface, said face including at least a muzzle portion extending outwardly of said first substantially flat surface;

a second substantially flat surface; and, fabric covering at least a portion of said second substantially flat surface.

18. The soft sculpted article as claimed in claim 17, including an attachment affixed to said fabric to form a tail extending outwardly of said second substantially flat surface.

19. The soft sculpted article as claimed in claim 17, wherein said fabric is formed to define a tail extending outwardly of said second substantially flat surface.

20. A soft sculpted article, which comprises:

a first substantially flat surface; and, a soft sculpted face affixed to said first substantially flat surface, said face including at least a muzzle portion extending outwardly of said first substantially flat surface, wherein said face includes:

a fabric covering at least a portion of said first substantially flat surface, and, a padding form disposed between said first substantially flat surface and said fabric.

21. The soft sculpted article as claimed in claim 20, including a substantially flat substrate disposed between said padding form and said first substantially flat surface.

22. The soft sculpted article as claimed in claim 21, wherein:

said padding form is affixed to said substrate;

said fabric is affixed to said substrate around said padding form; and, said substrate is affixed to said first substantially flat surface.

23. The soft sculpted article as claimed in claim 20, including:

a second substantially flat surface; and, fabric covering at least a portion of said second substantially flat surface.

* * * * *